US005811735A

United States Patent [19]

Quiroz

[11] Patent Number: 5,811,735

[45] Date of Patent: Sep. 22, 1998

[54] FINE PITCH FLAT CABLE HAVING IMPROVED CONNECTOR ALIGNMENT PROFILE

[75] Inventor: David Quiroz, Covina, Calif.

[73] Assignee: Thomas & Betts Corporation, Memphis, Tenn.

[21] Appl. No.: 761,449

[22] Filed: Nov. 22, 1996

[51] Int. Cl.[6] ..... H01B 7/08

[52] U.S. Cl. ..... 174/117 F; 439/499

[58] Field of Search ..... 174/117 F; 439/435, 439/395, 492, 499

[56] References Cited

U.S. PATENT DOCUMENTS

| | | | |
|---|---|---|---|
| 377,118 | 1/1888 | Schefbauer | 174/117 F |
| 1,421,168 | 6/1922 | Charm | 174/117 F |
| 3,170,160 | 2/1965 | Burniston . | |
| 3,444,506 | 5/1969 | Wedekind . | |
| 3,930,708 | 1/1976 | Wedekind et al. . | |
| 3,964,816 | 6/1976 | Narozny . | |
| 4,068,912 | 1/1978 | Hudson, Jr. et al. . | |
| 4,218,581 | 8/1980 | Suzuki . | |
| 4,638,117 | 1/1987 | Ney | 174/117 F |
| 4,666,019 | 5/1987 | Schaller . | |
| 4,847,443 | 7/1989 | Basconi | 174/117 F X |
| 5,104,336 | 4/1992 | Hatanaka et al. . | |

FOREIGN PATENT DOCUMENTS

| | | | |
|---|---|---|---|
| 3149710 | 6/1991 | Japan | 174/117 F X |
| 1 304 601 | 1/1973 | United Kingdom . | |

*Primary Examiner*—Dean A. Reichard
*Attorney, Agent, or Firm*—Hoffmann & Baron, LLP

[57] ABSTRACT

A flat, fine pitch cable assembly includes an improved cable profile to assist in the alignment with an insulation displacement connector. The improved profile has enlarged ridges which encompass multiple conductors thereby providing a surface which is more pronounced and therefore more suitable for alignment with an insulation displacement connector and the contacts supported thereby.

8 Claims, 2 Drawing Sheets

FINE PITCH FLAT CABLE HAVING IMPROVED CONNECTOR ALIGNMENT PROFILE

FIELD OF THE INVENTION

The present invention relates to flat, multi-conductor cables, and more particularly to a fine pitch flat multi-conductor cable having a modified profile for improved alignment with a mating connector.

BACKGROUND OF THE INVENTION

Flat multi-conductor cables suitable for use with insulation displacement connectors (IDC) are well known in the prior art. For example, U.S. Pat. No. 5,104,336 ('336 patent) issued to Hatakana et al., illustrates a flat cable suitable for use with an IDC connector. The '336 patent illustrates traditional round conductor flat cable having a plurality of generally circular conductors arranged in a parallel, planar configuration with each conductor being individually insulated. The insulated conductors are tangentially joined in a side-by-side array to form a single cable assembly. This cable features a symmetrical top and bottom profile, each profile including a plurality of ridges, one ridge corresponding to each of the conductors. These ridges aid in the alignment of the cable assembly with the mating connector. This is a significant consideration in IDC connectors, as proper alignment of the conductors of the cable with the insulation displacing contact of the connector is critical to proper cable termination.

U.S. Pat. No. 3,930,708 ('708 patent) to Wedekind et al. discloses a flat cable assembly having dissimilar top and bottom profiles. The top profile of the cable illustrated in the '708 patent includes a series of alignment ridges. Like the '336 patent, the '708 patent discloses a one to one correspondence between the conductors within the cable and the alignment ridges on the top profile of the cable. The bottom profile of the cable illustrated in the '708 patent is a flat, ridge-less profile which receives the contacts from an IDC connector. In the cable shown in the '708 patent, ample space is provided between the conductors. This allows the insulation displacement contacts to have sufficient clearance to terminate the conductors.

As system integration and consumer demand force the overall size of electronic products into smaller configurations, the cable assemblies required to build these products must also be reduced in size. However, while the profiles illustrated in the prior art are suitable for use in cable assemblies when the conductors are spaced significantly apart, as the conductor pitch (conductor spacing) decreases, the ridge size similarly decreases. Ultimately, when the conductor pitch is fine (spacing of conductors less than 0.050 inches), the profile provided by the one to one, ridge to conductor, arrangement is no longer adequate to aid in the alignment of the conductors to a mating IDC connector. As a result, the fine pitch cables required for modem assemblies having such a profile are difficult to align and terminate. This alignment difficulty, encountered because of the small ridges in fine pitch cables, results in cable assemblies which are unreliable and expensive to fabricate.

It is therefore desirable to provide a fine pitch cable assembly which may be easily and accurately terminated with a fine pitch IDC connector.

SUMMARY OF THE INVENTION

It is an object of the present invention to present a flat, fine pitch multi-conductor cable with improved connector alignment characteristics.

It is another object of the present invention to provide a cable profile for a fine pitch multi-conductor cable which facilitates improved alignment with a suitable mating connector.

It is yet another object of the present invention to provide a flat, fine pitch multi-conductor cable which overcomes the problems noted in the prior art.

In accordance with one form of the present invention a fine pitch cable having plural conductors which are electrically insulated from one another and tangentially joined to form a planar cable structure is formed. The cable includes a connector alignment face and an opposed connector contact face. The connector alignment face features at least one arcuate alignment ridge having a chord length, this alignment ridge encompasses two or more conductors within the chord length. The connector contact face preferably has plural conductor ridges, with each conductor ridge corresponding to a single conductor. This arrangement provides for a more pronounced ridge on the connector alignment face which allows more positive alignment with a suitably matched IDC connector structure.

A preferred form of the flat cable assembly of the present invention, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
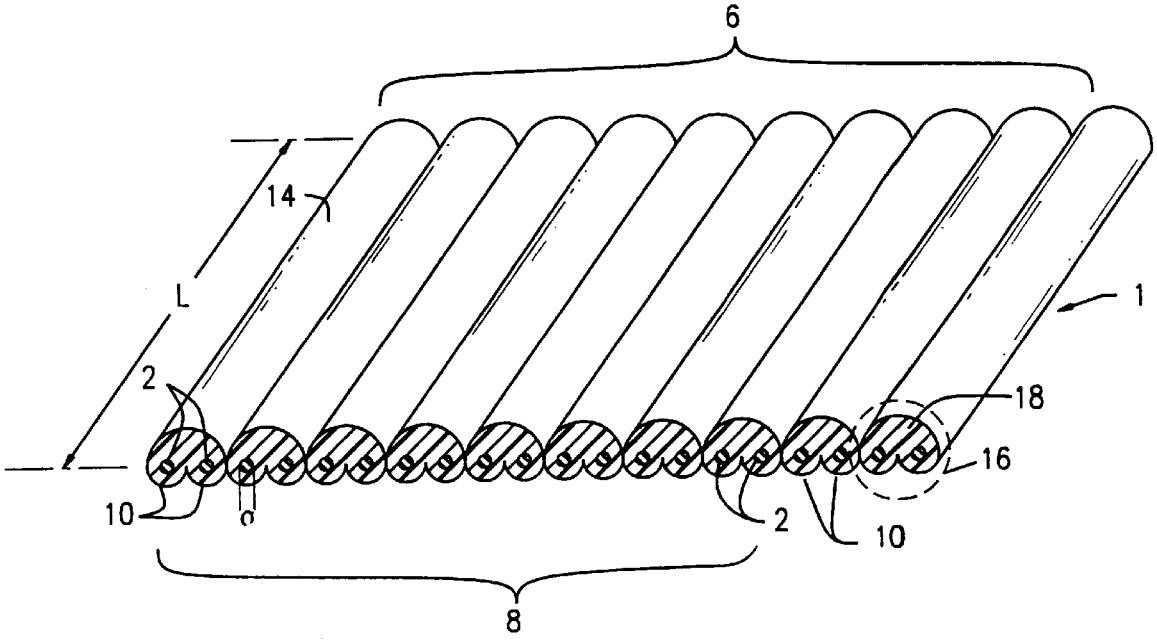
FIG. 1 illustrates a perspective view of the flat cable assembly of the present invention showing both a cross section and the alignment surface of the cable assembly.

FIG. 1 illustrates a preferred embodiment of the flat cable assembly 1 formed in accordance with the present invention. A plurality of electrical conductors 2 having a length, L, and a cross sectional diameter, d, are aligned to be substantially parallel and substantially planar. A conductor axis is defined from the center of the cross sectional diameter and running along the length of the respective conductors. The conductors 2 may be formed of any suitably electrically conductive materials which may include solid metal wire, stranded metal wire, compressed carbon composition, or conductive polymers. The geometry of the cross sectional diameter of the conductors is shown in the preferred embodiment to be round. However, other cross-sectional conductor shapes may also be employed. In a preferred embodiment the conductors are formed using 30 AWG, stranded copper wire having a substantially circular cross section.

Figure 2:
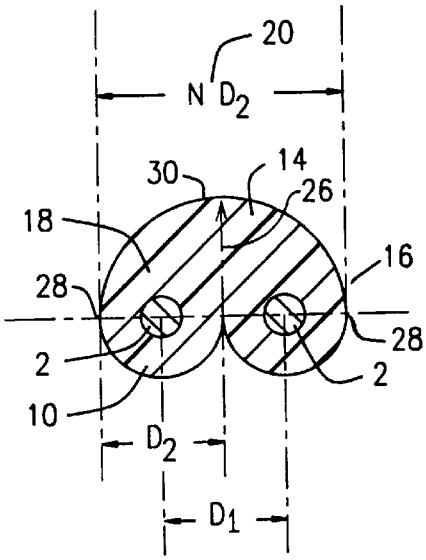
FIG. 2 is a cross sectional view of the cable assembly showing the conductors and insulating member in detail.

FIG. 2 is a cross sectional view taken at location 16 in FIG. 1. This view illustrates that the conductors 2 are spaced equidistant from one another with a center to center spacing, $D_1$. The magnitude of $D_1$ illustrated in FIG. 2 is less than 0.050 inches (1.3 mm) for fine pitch cables. The conductors 2 are encapsulated in an insulating material 18 to form a single, planar, multi-conductor cable assembly having a connector alignment face 6 and an opposed conductor contact face 8. The insulating material 18 may be any conventional electrically insulative material. The insulative material 18 is typically positioned over the conductors 2 in an extrusion process. In the preferred embodiment the insulating material is polyvinyl chloride.

Referring to FIGS. 1 and 2, conductor contact face 8 is formed to have a profile preferably including a series of substantially semi-circular undulations or ridges 10. Each ridge 10 has a diameter $D_2$ approximately equal to $D_1$, the center to center spacing of the conductors 2, and are situated to form a hemisphere about each conductor 2.

The connector alignment face 6 includes a series of arcuate undulations or ridges 14. Each ridge 14 is defined by two arc endpoints 28 having an arc segment 30, and a length, L, with an axis associated therewith. The spacing between the arc endpoints 28 is the chord length 20 of the arcuate ridge 14. Each arcuate ridge 14 envelops at least two conductors 2 within the arc segment 30. The chord length 20 is substantially equal to $N \cdot D_2$, where N is the number of conductors 2 within the arc segment 30 and $D_2$ is the diameter of the semi-circular ridges 10 of the connector contact face 8. The height 26 of the arcuate ridges 14 is selected to provide an adequate insulation thickness and to provide a well defined arched surface suitable for facilitating connector alignment as will be described hereinbelow.

In the preferred embodiment of the present invention, the flat cable assembly 1 is formed having a conductor pitch of 0.025" (0.65 mm) with two conductors interposed within each arcuate ridge 14. The arcuate ridges 14 are substantially semi-circular, with a cord length 20 of 0.050" (1.3 mm) and a height 26 of approximately 0.025" (0.65 mm). In this configuration, flat cables with an even number of conductors may be formed having connector alignment ridges which are substantially twice the size of the ridge of prior art cable assemblies.

Figure 3:
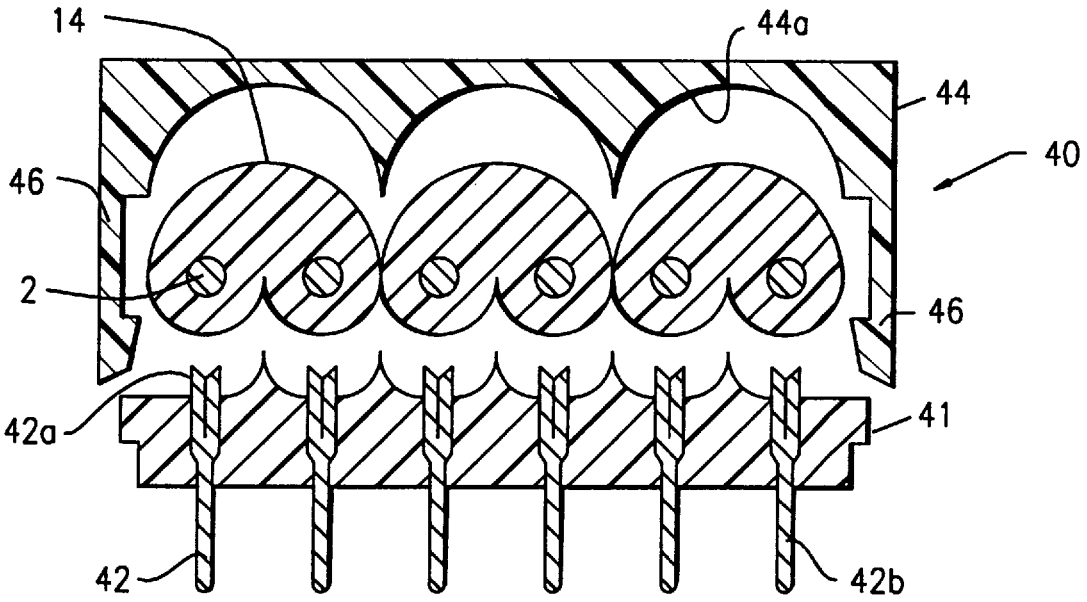
FIG. 3 illustrates a cable formed in accordance with the present invention aligned with a suitable IDC connector assembly.

The advantage inherent in these enlarged ridges is illustrated in FIG. 3. Cable assembly 1 formed in accordance with the present invention is shown in cooperation with a suitably matched IDC connector 40. IDC connector 40 may be of conventional construction having a connector housing 41 supporting plural spaced IDC contacts 42. Each IDC contact has an IDC portion 42*a* and an opposed tail 42*b* for mating electrical connection. IDC connector 40 includes a cover 44 having an undulated lower surface 44*a*. Cable 1 is designed to have its connector alignment face 6 include ridges 14 which match the undulations of lower surface 44*a* of cover 44.

The cable 1 is interposed between the cover 44 and housing 41. The enlarged arcuate ridges 14 of cable 1 provide a pronounced mating surface for the cover 44 of IDC connector 40. This surface aligns the conductors 2 of the cable over the corresponding IDC portions 42*a* of contacts 42. The cable 1 is terminated by urging cover 44 onto housing 41 with cable 1 supported therebetween. The IDC portions 42*a* are urged into IDC connection with conductors 2 of cable 1. The interfitting of ridges 14 with the lower surface 44*a* of cover 44 assures alignment of the IDC contacts 42 with conductors 2. Opposed latch arms 46 of cover 44 engage housing 41 and assure proper alignment of cover 44 with housing 41.

Figure 4:
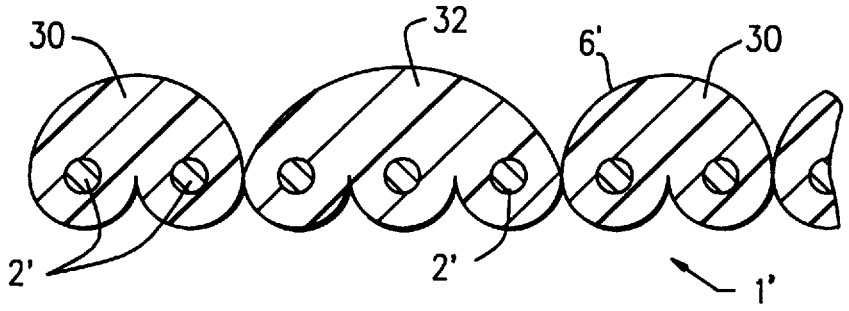
FIG. 4 illustrates an alternate embodiment of the present invention suitable for cable assemblies with an odd number of conductors.

The present invention may also be employed in other cable configurations. A cable 1' may be formed having a varying profile including arcuate ridges on surface 6' having two conductors 2' per arcuate ridge 30 and at least one arcuate ridge 32 encompassing three conductors 2' per ridge as is illustrated in FIG. 4. In order to maintain an odd number of conductors in this configuration, there must be an odd number of arcuate ridges 32 on surface 6 that encompass three conductors. While it is possible to form the arcuate ridges with more than three conductors per ridge, in these alternate embodiments manufacturing constraints regarding the insulation thickness will ultimately provide an upper limit on the number of conductors per arcuate ridge.

It will be appreciated by those skilled in the art that this profile provided by the present invention provides a well defined ridge structure for a fine pitch cable which facilitates easy alignment with an IDC connector and the contacts supported thereby and overcomes many problems associated with prior art cable/connection structures.

Although the illustrative embodiments of the present invention have been described herein with reference to the accompanying drawings, it is to be understood that the invention is not limited to those precise embodiments and that various other changes and modifications may be effected therein by one skilled in the art without departing from the scope of the invention.

What is claimed is:

1. A fine pitch multi-conductor flat cable assembly having a profile for alignment and mating with a suitable connector, said assembly comprising:

a plurality of elongate electrical conductors being aligned with one another in a substantially parallel and planar orientation; and an insulating member encompassing said conductors, said insulating member having opposed first and second faces, said first face having a plurality of semi-cylindrical first elongate ridges, a number of said first ridges on said first face being equal to a number of said conductors, each of said semi-cylindrical first ridges being substantially aligned with one of said conductors, said second face having plural arcuate second elongate ridges, each said arcuate second elongate ridge encompassing at least two of said conductors;

whereby said plural second ridges define guide surfaces to guide said cable assembly into proper alignment during mating with said connector.

2. A fine pitch multi-conductor flat cable assembly, as defined by claim 1, wherein:

said plurality of conductors is of a number equal to $2 \cdot N$ where N is an integer value grater than 1; and wherein there are N said arcuate second ridges, each said arcuate second ridge encompassing two of said conductors.

3. A fine pitch multi-conductor flat cable of claim 1 wherein:

said plurality of conductors is of a number equal to $X \cdot N$ where N is an integer value greater than 1, and X is an integer value greater than 2;

and, wherein there are N said arcuate second ridges, each said arcuate second ridge encompassing X of said conductors.

4. A fine pitch multi-conductor flat cable assembly of claim 1 wherein each of said plural arcuate second ridges encompasses a pair of said conductors.

5. A fine pitch multi-conductor flat cable assembly of claim 4 wherein a width of each of said plural arcuate second ridges is approximately twice a width of each first ridge of said number of first ridges.

6. A fine pitch multi-conductor flat cable assembly of claim 1 wherein said conductors are spaced apart a given pitch and wherein said first ridges each have a width approximately equal to said given pitch.

7. A fine pitch multi-conductor flat cable assembly for alignment and mating with a suitable connector, said cable comprising:

at least five elongate conductors, each of the at least five conductors being aligned in a co-planar parallel array; and an insulating member encompassing said conductors, the insulating member having opposed first and second faces, said first face having a plurality of elongate semi-cylindrical ridges, said semi-cylindrical ridges each having a given diameter, a number of said semi-cylindrical ridges being equal to a number of said conductors, each of said semi-cylindrical ridges being substantially aligned with one of said conductors, said second face including elongate first and second arcuate mating ridges, each said first arcuate mating ridge encompassing two of said conductors, each said second arcuate mating ridge encompassing three of said conductors, said cable assembly being formed having at least one of said first arcuate mating ridge and an odd number of said second arcuate mating ridges whereby said cable assembly having an odd number of said conductors is formed.

8. A fine pitch multi-conductor flat cable of claim 7 wherein each of said mating ridges encompass in transverse succession alternating odd and even numbers of said conductors respectively.

* * * * *